US008011318B1

(12) United States Patent
Gilmour

(10) Patent No.: US 8,011,318 B1
(45) Date of Patent: Sep. 6, 2011

(54) ARTICLE SUPPORT SYSTEM

(76) Inventor: Christopher L. Gilmour, Orwell, OH (US)

( * ) Notice: Subject to any disclaimer, the term of this patent is extended or adjusted under 35 U.S.C. 154(b) by 1022 days.

(21) Appl. No.: 11/766,407

(22) Filed: Jun. 21, 2007

(51) Int. Cl.
*B05C 13/02* (2006.01)

(52) U.S. Cl. ..... 118/500; 269/296; 269/903; 269/909; 118/501

(58) Field of Classification Search ..... 160/382, 160/23.1; 248/125.1, 126, 201, 300, 346.01, 248/346.02, 351, 354.1, 357, 511, 512, 518, 248/534, 682, 684, 688, 694; 269/296, 903, 269/909
See application file for complete search history.

(56) References Cited

U.S. PATENT DOCUMENTS 1,237,170 A * 8/1917 Cline ..... 108/90
1,393,054 A * 10/1921 Turner ..... 211/60.1
1,891,629 A 12/1932 Van Wagner
3,952,758 A 4/1976 Addison et al.
4,156,449 A * 5/1979 Petersen ..... 160/290.1
4,325,323 A 4/1982 Rioux
4,903,796 A * 2/1990 Magyar et al. ..... 182/129
5,340,187 A 8/1994 Haddad, Jr.
5,769,368 A * 6/1998 Busey ..... 248/125.7
D417,117 S 11/1999 Gerk
6,179,915 B1 * 1/2001 Chen ..... 118/52
6,279,763 B1 * 8/2001 Bush ..... 211/195
7,328,466 B1 * 2/2008 Bowen ..... 4/558
2002/0069792 A1 * 6/2002 Alcala et al. ..... 108/25
* cited by examiner

*Primary Examiner* — Dah-Wei D Yuan
*Assistant Examiner* — Charles J Capozzi

(57) ABSTRACT

An article support system for supporting articles and collecting paint or stain that drips off of the articles includes a plurality of stanchions being positioned and upwardly extending from a support surface. Each of the stanchions includes a top wall, a bottom wall and a perimeter wall that extends between the top wall and the bottom wall. Each of a plurality of span assemblies is mounted to a pair of the stanchions and extends between the stanchions. The span assemblies support the articles above the support surface when the articles are placed on and extend between the span assemblies positioned adjacent each other.

8 Claims, 5 Drawing Sheets

ARTICLE SUPPORT SYSTEM

BACKGROUND OF THE INVENTION

1. Field of the Invention

The present invention relates to drop cloth holders and more particularly pertains to a new drop cloth holder for supporting articles and collecting paint or stain that drips off of the articles.

2. Description of the Prior Art

The use of drop cloth holders is known in the prior art. While these devices fulfill their respective, particular objectives and requirements, the need remains for a system that has certain improved features that allow for the system to be setup to handle any length of articles to be painted or stained while the system collects paint or stain that drip from the articles. Additionally, the system should include male nubs to allow multiple levels of span assemblies to be stacked to allow painting or staining of multiple layers of articles.

SUMMARY OF THE INVENTION

The present invention meets the needs presented above by generally comprising a plurality of stanchions being positioned and upwardly extending from a support surface. Each of the stanchions includes a top wall, a bottom wall and a perimeter wall that extends between the top wall and the bottom wall. Each of a plurality of span assemblies is mounted to a pair of the stanchions and extends between the stanchions. The span assemblies support the articles above the support surface when the articles are placed on and extend between the span assemblies positioned adjacent each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
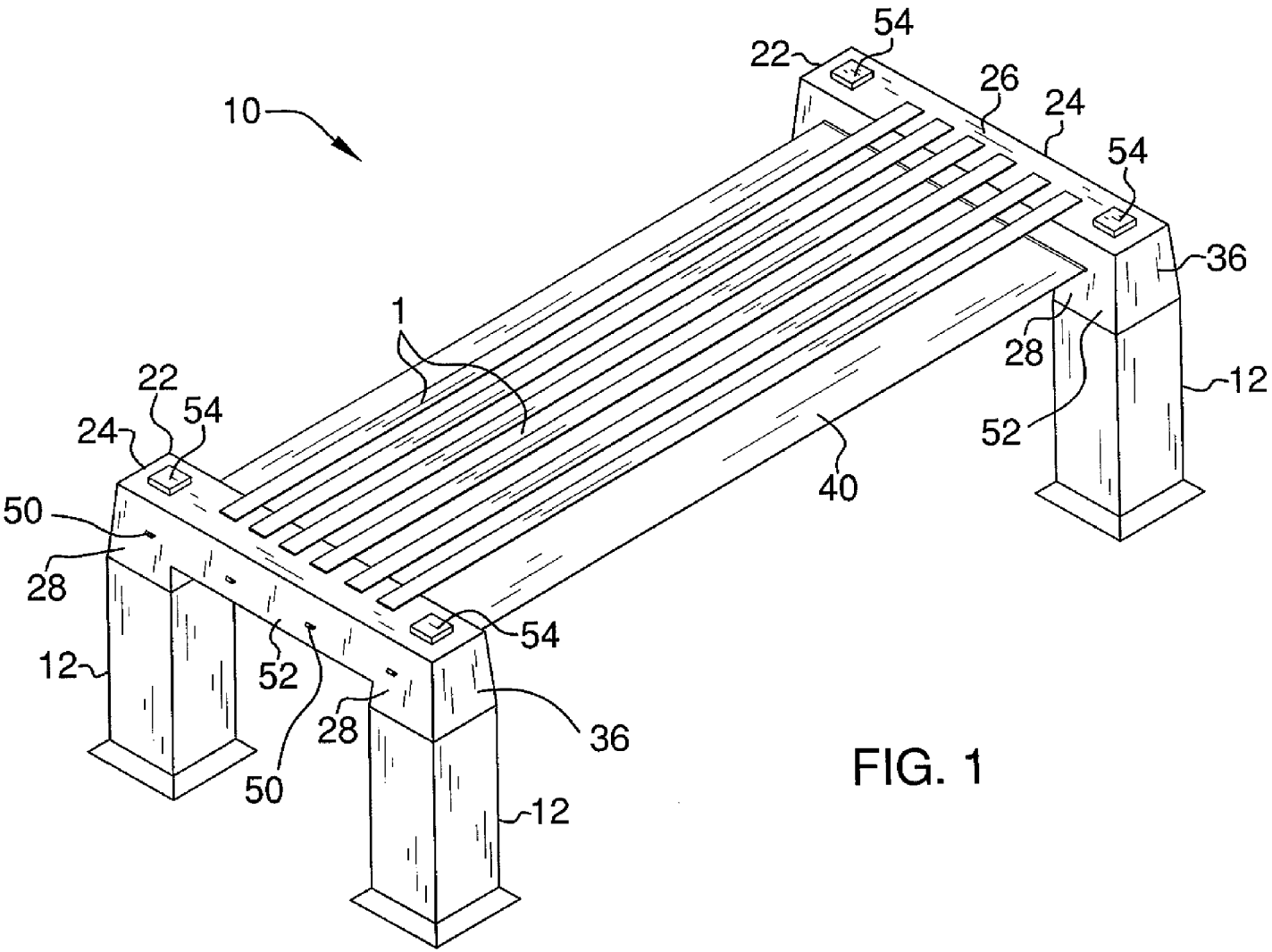
FIG. 1 is a perspective view of a article support system according to the present invention shown in use with articles to be painted or stained.
Figure 2:
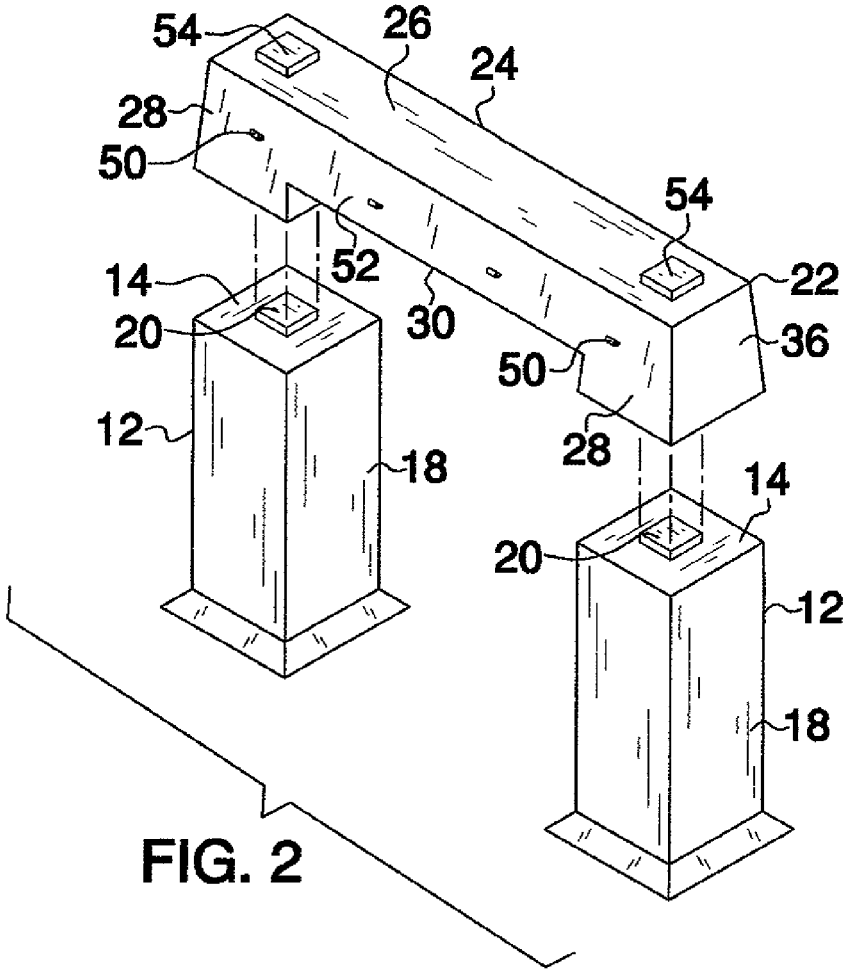
FIG. 2 is an exploded perspective view of a pair of stanchions and a span assembly of the present invention.
Figure 3:
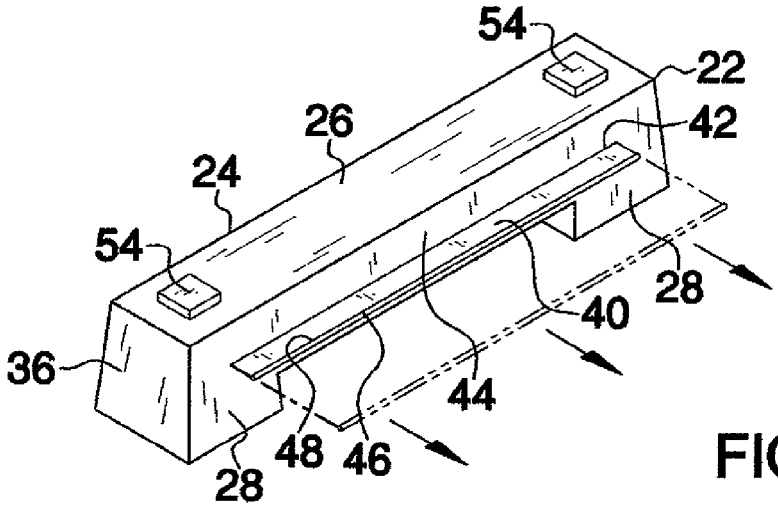
FIG. 3 is a perspective view of one of the span assemblies of the present invention with the drop being extended.
Figure 4:
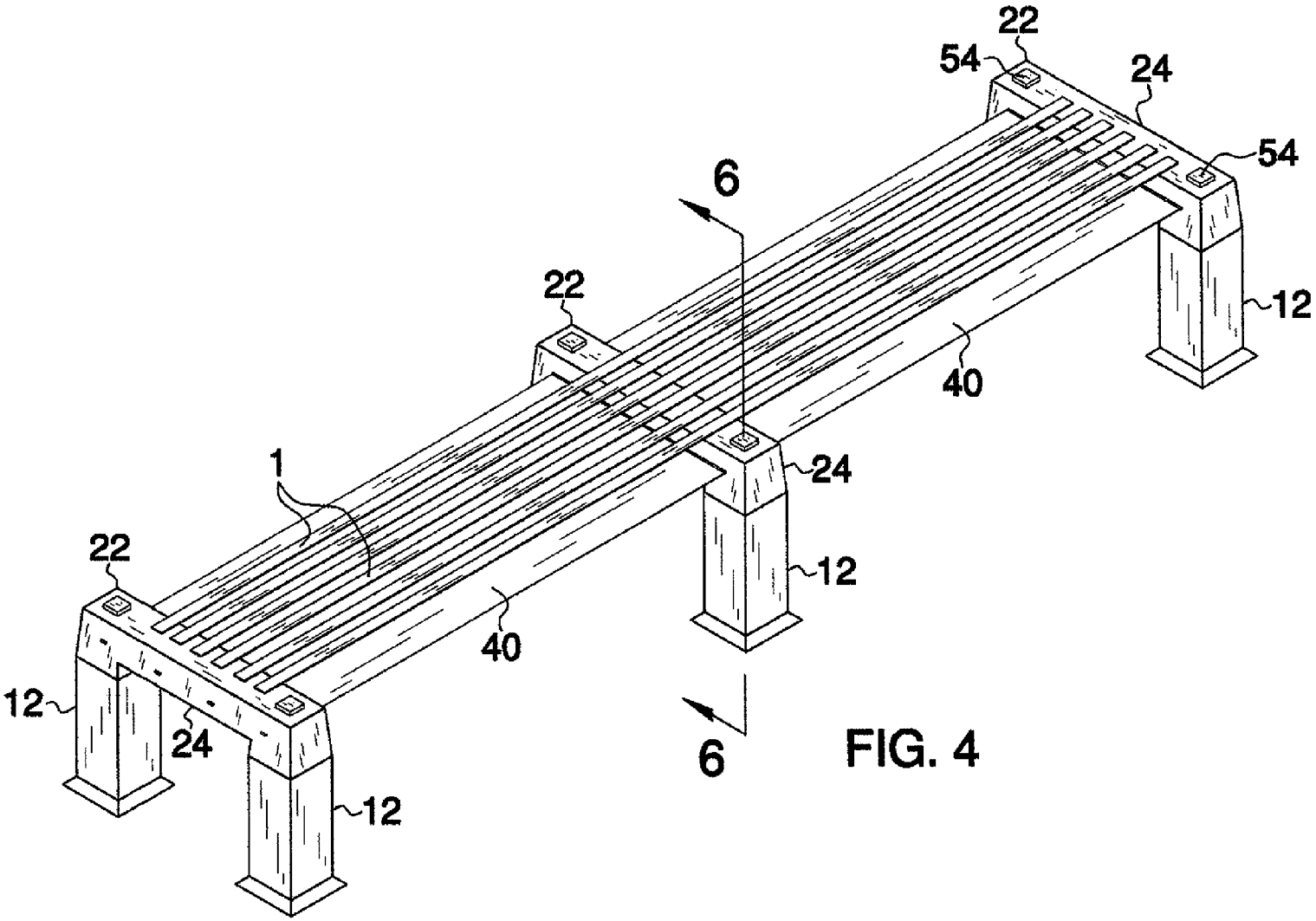
FIG. 4 is a perspective view of the present invention shown arranged to accommodate long articles.
Figure 5:
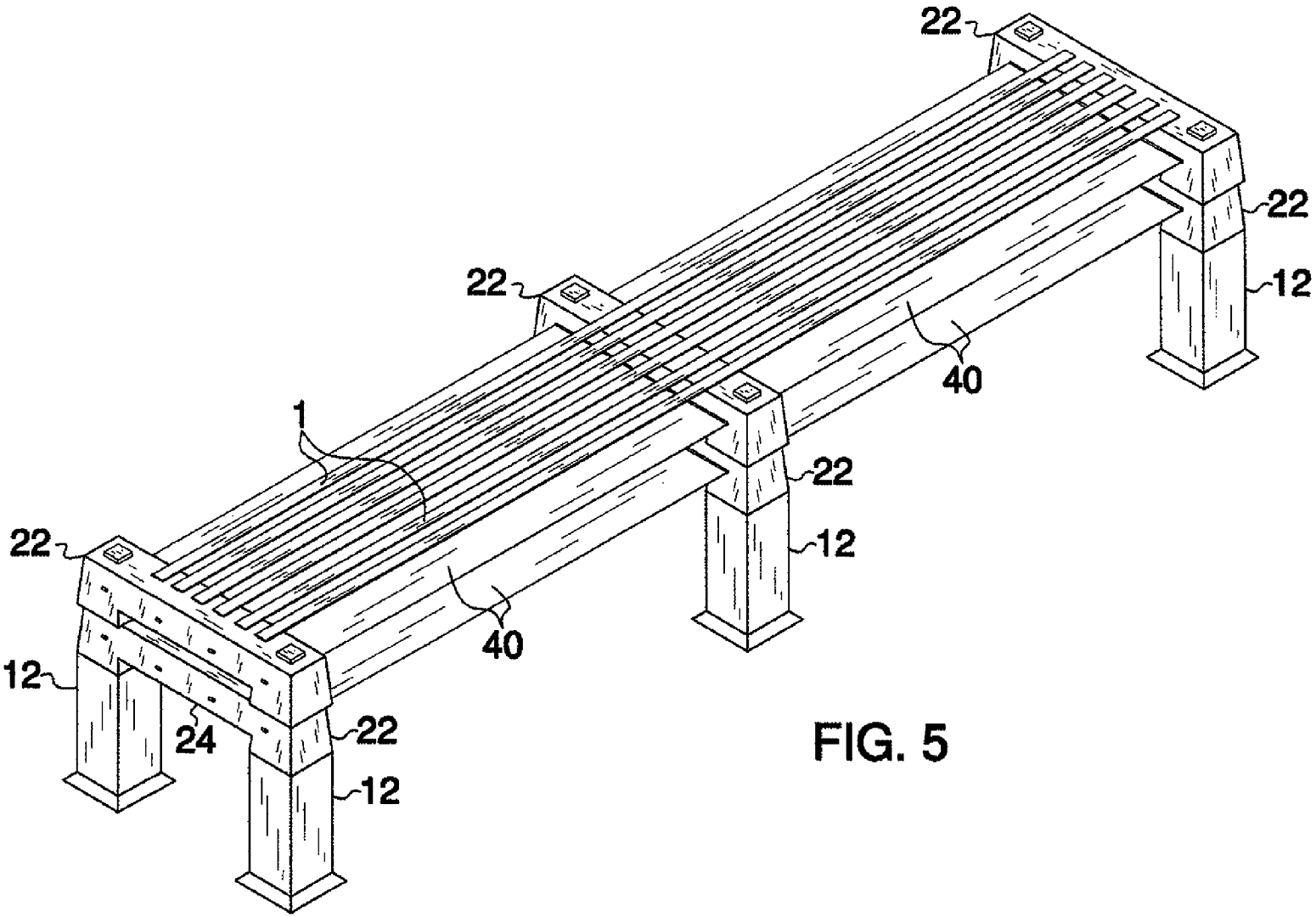
FIG. 5 is a perspective view of the present invention shown arranged to accommodate multiple levels of articles.
Figure 6:
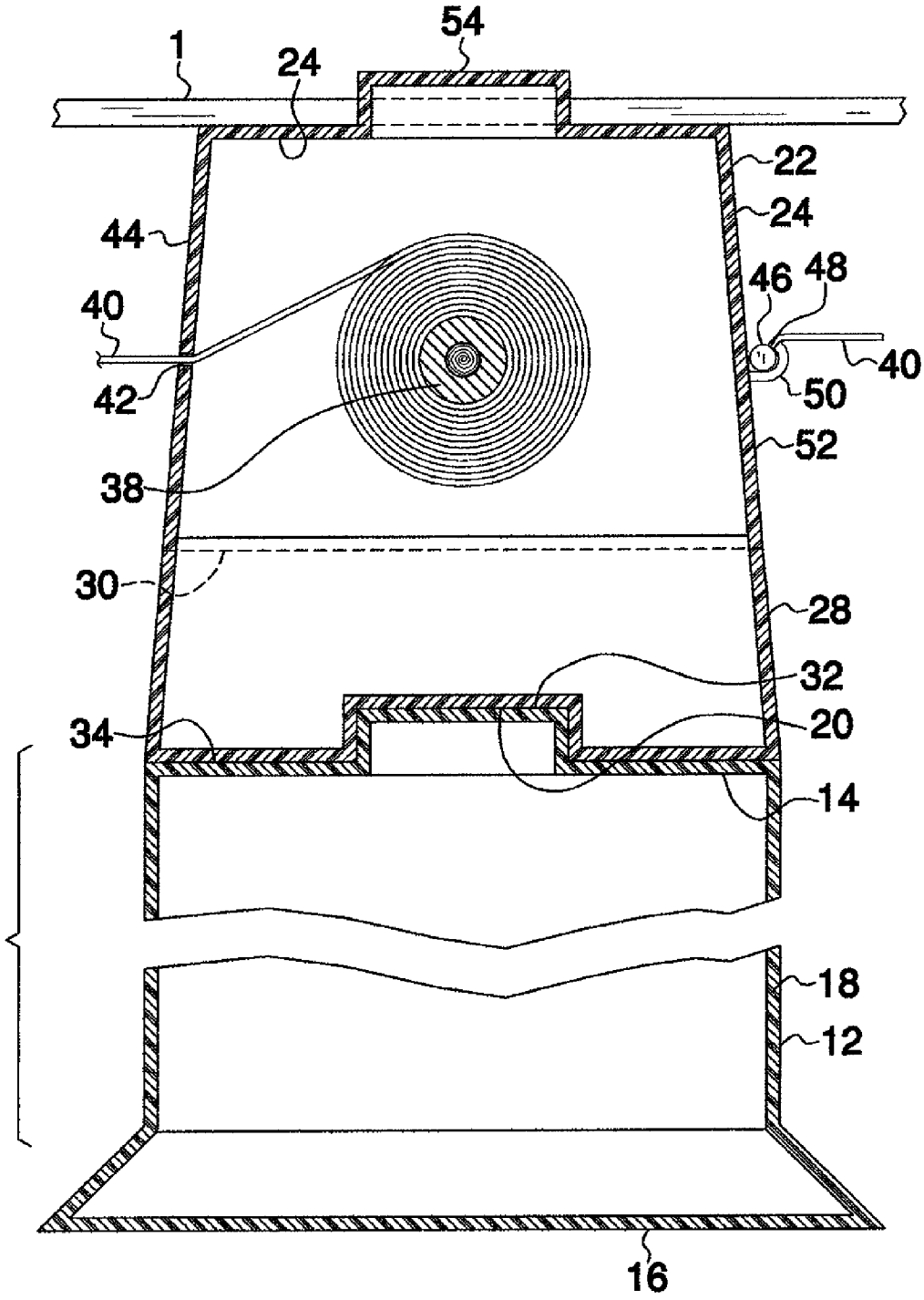
FIG. 6 is a cross-sectional view of the present invention taken along line 6-6 of FIG. 4.

With reference now to the drawings, and in particular to FIGS. 1 through 6 thereof, a new drop cloth holder embodying the principles and concepts of the present invention and generally designated by the reference numeral 10 will be described.

As best illustrated in FIGS. 1 through 6, the article support system 10 generally comprises a plurality of stanchions 12 being positioned and that upwardly extend from a support surface. Each of the stanchions 12 includes a top wall 14, a bottom wall 16 and a perimeter wall 18 extending between the top wall 14 and the bottom wall 16. Each of the stanchions 12 includes an alignment nub 20 coupled to and that extends upwardly from the top wall 14. Each of the stanchions 12 has a height of approximately 2 feet.

Each of a plurality of span assemblies 22 is mounted to a pair of the stanchions 12 and extends between the stanchions 12. The span assemblies 22 support articles 1 above the support surface when the articles 1 are placed on and extend between the span assemblies 22 positioned adjacent each other. Each of the span assemblies 22 includes a housing 24 that extends between the associated pair of the stanchions 12. The housing 24 includes a top face 26 to support the articles 1 placed on the associated one of the span assemblies 22. The housing 24 has a length of approximately 4 feet and a width between approximately 3 inches and approximately 4 inches.

Each of span assemblies 22 additionally includes a pair of risers 28 coupled to and that extend downwardly from a bottom face 30 of the housing 24. Each of the stanchions 12 receives one of the risers 28 to raise the bottom face 30 of the housing 24 above the top wall 14 of each of the stanchions 12. Each of the risers 28 has a receiving depression 32 that extends into the associated one of the risers 28 through a bottom surface 34 of the associated one of the risers 28. The receiving depression 32 of each of the risers 28 receives the alignment nub 20 of one of the stanchions 12 to inhibit the housing 24 sliding off of the associated pair of the stanchions 12. Each of a pair of ends 36 of the housing 24 has one of the risers 28 positioned adjacent thereto.

Each of the span assemblies 22 also includes a spooling rod 38 rotatably coupled to and positioned in the housing 24. A drop cloth 40 is coupled to and spooled onto the spooling rod 38. The drop cloth 40 is extendable through a slot 42 in a front face 44 of the housing 24. The drop cloth 40 is extended between a pair of the span assemblies 22 to collect the paint and the stain that drips from the articles 1. The spooling rod 38 is biased to roll the drop cloth 40 on to the spooling rod 38 when the drop cloth 40 is not is extended between the span assemblies 22.

The span assemblies 22 each include an end bar 46 coupled to and that extends across a width of a free end 48 of the drop cloth 40. The end bar 46 is grasped to facilitate extending of the drop cloth 40 between the span assemblies 22. The end bar 46 inhibits the free end 48 from being drawn into the housing 24 when the drop cloth 40 is rolled on to the spooling rod 38. A plurality of hooks 50 is coupled to a rear face 52 of the housing 24. Each of the hooks 50 receives the end bar 46 of an adjacently positioned one of the span assemblies 22 to secure the drop cloth 40 between the span assemblies 22.

Additionally, each of the span assemblies 22 includes a plurality of male nubs 54 coupled to and that upwardly extend from the top face 26 of the housing 24. Each of the ends 36 of the housing 24 has one of the male nubs 54 positioned adjacent thereto. The receiving depression 32 of each of the risers 28 of an upper one of the span assemblies 22 receives the male nubs 54 of a lower one of the span assemblies 22 to inhibit sliding of one of the span assemblies 22 with respect to the other when the span assemblies 22 are stacked. The risers 28 of the upper one of the span assemblies 22 raise the housing 24 of the upper one of the span assemblies 22 above the articles 1 on the lower one of the span assemblies 22 to inhibit contact between the upper one of the span assemblies 22 and the articles 1.

In use, the stanchions 12 are placed on the support surface and the span assemblies 22 are placed on an adjacently positioned pair of the stanchions 12. The end bar 46 is grasped to draw the drop cloth 40 out of the housing 24 and to extend the drop cloth 40 between the span assemblies 22. The end bar 46 is placed into the hooks 50 of the adjacent one of the span assemblies 22. The articles 1 are placed on the span assemblies 22 to allow the articles 1 to extend between the span assemblies 22 when the paint or stain is applied and the drop cloth 40 catches any of the paint or stain that drips from the articles 1.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An article support system for supporting articles that are to be painted and stained, said system comprising:

a plurality of stanchions being positioned and upwardly extending from a support surface, each of said stanchions including a top wall, a bottom wall and a perimeter wall extending between said top wall and said bottom wall, said stanchions being independent of each other such that each forms a single vertical support being uncoupled to other ones of said stanchions;

a plurality of span assemblies, at least one of said span assemblies being removably mounted to a pair of said stanchions and at least one more of said span assemblies being removably mounted to another pair of said stanchions, wherein there are at least four of said stanchions and that for every pair of said stanchions there is at least one of said span assemblies, said span assemblies being unattached to each other and supporting the articles above the support surface when the articles are placed on and extending between said span assemblies positioned adjacent each other;

each of said span assemblies including a housing extending between the associated pair of said stanchions, said housing including a top face to support the articles placed on the associated one of said span assemblies, wherein at least one of said span assemblies includes:

a spooling rod being rotatably coupled to and positioned in said housing;

a drop cloth being coupled to and spooled onto said spooling rod, said drop cloth being extendable through a slot in a front face of said housing, said drop cloth being extended from one of said span assemblies and removably coupled to another one of said span assemblies to collect the paint and the stain that drips from the articles, said drop cloth lying below a plane of said top faces of said housings of said span assemblies between which said drop cloth extends, said spooling rod being biased to roll said drop cloth on to said spooling rod when said drop cloth is not being extended between said span assemblies; and wherein said span assemblies may be removably stacked directly on each other such that articles are positioned between stacked ones of said span assemblies.

2. The system according to claim 1, wherein each of said span assemblies includes an end bar being coupled to and extending across a width of a free end of said drop cloth, said end bar being grasped to facilitate extending of said drop cloth between said span assemblies, said end bar inhibiting said free end from being drawn into said housing when said drop cloth is being rolled on to said spooling rod.

3. The system according to claim 2, wherein each of said span assemblies includes a plurality of hooks being coupled to a rear face of said housing, each of said hooks receiving said end bar of an adjacently positioned one of said span assemblies to secure said drop cloth between said span assemblies.

4. The system according to claim 1, wherein each of said span assemblies includes a pair of risers being coupled to and extending downwardly from a bottom face of said housing, each of said stanchions receiving one of said risers to raise said bottom face of said housing above said top wall of each of said stanchions.

5. The system according to claim 4, wherein each of said stanchions includes an alignment nub being coupled to and extending upwardly from said top wall of the associated one of said stanchions.

6. The system according to claim 5, wherein each of said risers has a receiving depression extending into the associated one of said risers through a bottom surface of the associated one of said risers, said receiving depression of each of said risers receiving said alignment nub of one of said stanchions to inhibit said housing sliding off of the associated pair of said stanchions.

7. The system according to claim 6, wherein each of a pair of ends of said housing having one of said risers positioned adjacent thereto.

8. The system according to claim 6, wherein each of said span assemblies includes a plurality of male nubs being coupled to and upwardly extending from said top face of said housing, each of a pair of ends of said housing having one of said male nubs positioned adjacent thereto, said receiving depression of each of said risers of an upper one of said span assemblies receiving said male nubs of a lower one of said span assemblies to inhibit sliding of one of said span assemblies with respect to the other when said span assemblies are stacked, said risers of the upper one of said span assemblies raising said housing of the upper one of said span assemblies above the articles on the lower one of said span assemblies to inhibit contact between the upper one of said span assemblies and the articles.

* * * * *